US008109593B2

(12) United States Patent
Oohashi et al.

(10) Patent No.: US 8,109,593 B2
(45) Date of Patent: Feb. 7, 2012

(54) SUBSTRATE FOR INKJET HEAD AND INKJET HEAD USING THE SAME

(75) Inventors: Ryoji Oohashi, Yokohama (JP); Yoshiyuki Imanaka, Kawasaki (JP); Koichi Omata, Kawasaki (JP); Takaaki Yamaguchi, Yokohama (JP); Hideo Tamura, Kawasaki (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 451 days.

(21) Appl. No.: 12/472,908

(22) Filed: May 27, 2009

(65) Prior Publication Data

US 2009/0295859 A1 Dec. 3, 2009

(30) Foreign Application Priority Data

May 30, 2008 (JP) ..... 2008-142677

(51) Int. Cl.
*B41J 29/38* (2006.01)

(52) U.S. Cl. ..... 347/17; 347/9; 347/12

(58) Field of Classification Search ..... 347/9, 12, 347/17

See application file for complete search history.

(56) References Cited

U.S. PATENT DOCUMENTS

| | | | | |
|---|---|---|---|---|
| 6,074,034 | A * | 6/2000 | Maeda | 347/17 |
| 6,598,952 | B2 * | 7/2003 | Ishinaga et al. | 347/17 |
| 6,945,629 | B2 | 9/2005 | Yamaguchi et al. | |
| 2007/0103498 | A1 * | 5/2007 | Parish et al. | 347/17 |
| 2008/0100649 | A1 | 5/2008 | Matsui et al. | |
| 2008/0111864 | A1 | 5/2008 | Yamaguchi et al. | |

FOREIGN PATENT DOCUMENTS

| | | |
|---|---|---|
| JP | 02-258266 | 10/1990 |
| JP | 2002-307685 | 10/2002 |
| JP | 2004-050637 | 2/2004 |

* cited by examiner

*Primary Examiner* — Matthew Luu
*Assistant Examiner* — Jannelle M Lebron
(74) *Attorney, Agent, or Firm* — Fitzpatrick, Cella, Harper & Scinto

(57) ABSTRACT

A substrate has M×N heater elements divided into N blocks and time divisionally driven in units of the block, and signal lines for supplying M bits of signals for selecting elements to be driven in each block. The signal lines are divided into two groups, each extending toward the center of a heater element array from a start point at either end side of the array in the array direction, and being used to select M/2 elements closest to the end side of the array. In each groups, the M/2 bit signal lines are arranged so that the number of the signal lines is decremented as the distance from the start point increases, and that the remaining signal lines are shifted toward the array. A temperature sensor for the substrate is provided in an empty area produced at a position corresponding to the center of the array by the shift.

9 Claims, 17 Drawing Sheets

SUBSTRATE FOR INKJET HEAD AND INKJET HEAD USING THE SAME

BACKGROUND OF THE INVENTION

1. Field of the Invention

The present invention relates to an inkjet head for performing print on a print medium by ejecting ink according to an inkjet system and a substrate for the inkjet head.

2. Description of the Related Art

Depending on various inkjet systems, there are various types of inkjet heads (hereinafter, also referred to as inkjet print heads or print heads) used in printing apparatuses (hereinafter, also referred to as printers) that make print by applying ink onto print media such as printing paper. In one of the systems, an inkjet print head heats ink to form bubbles by using, as an energy generating element (also called a print element), a heater element (also called a heater) configured of a heating resistor that generates heat in response to conduction, and makes print by using pressure generated from the bubbles thus formed. This enables highly fine printing at high speed because it is easy to highly accurately manufacture a substrate for a print head substrate in which a large number of heater elements, wirings and the like are arranged with a high density. Moreover, this leads to achievement of further size reduction of a print head and accordingly a printer using the print head.

If all of a large number of heater elements thus arranged are driven at one time, a large amount of current flows into the print head instantaneously. To avoid this situation, several tens to several hundreds of heater elements are divided into several blocks, and the blocks of heater elements are driven at slightly different timings. By reducing the number of heater elements driven at one time as described above, the total amount of instantaneously flowing current is limited to a predetermined low level. Moreover, heater element drive circuits for driving a large number of heater elements are incorporated in the print head. This configuration is intended to prevent an increase in the number of wirings between the print head and a printer in which the print head is mounted. In widely used configurations, these drive circuits are built in a Si (silicon) wafer used as a substrate for forming the heater elements.

There are various configurations of the drive circuits. Here, a configuration disclosed in Japanese Patent Laid-Open No. 2002-307685 is described as a typical configuration.

The driving of each heater element is controlled in accordance with a block control signal (BLKn) indicating a number of a block to which the heater element belongs, and a print signal (DATA) corresponding to the block control signal (DATA). As the block control signal (BLKn), binary data obtained by encoding a block number are used. Here, a value calculated by dividing the total number of heater elements (T) by the total number of blocks (N) indicates the number of heater elements (M=T/N) drivable at one time in one driving operation. Moreover, one bit of the print data corresponds to one heater element. If the print data are transferred in an amount corresponding to the number of heater elements that are simultaneously driven at one driving operation in a time division driving, M represents the number of bits of the print signals (DATA) for driving the heater elements simultaneously driven in one operation.

Moreover, gates and transistors are provided for the number of bits equal to the number of heater elements (T). In addition, a shift register and a latch circuit are provided for the number of bits of the block control signals (BLKn) and the number of bits of the print signals (DATA) for simultaneously driving the heater elements in one driving operation. Data composed of the print signals (DATA) and the block control signals (BLKn) are serially transferred to the shift register from a controller of printer main body. After the print signals (DATA) are aligned in the shift register, the print signals (DATA) are latched by the latch circuits. For each block, drive signals are obtained by decoding the block control signals, and the obtained drive signals and the latched print signals are inputted to the gates. In response to this input, the transistors corresponding to the heater elements of the block are driven. Incidentally, this patent document discloses that a usable type of transistors is a bipolar transistor or a field effect transistor (FET).

As for an inkjet print head, the ejection characteristics of ink ejected from ejection openings and the temperature of the substrate for the print head are closely related to each other. For this reason, detecting the substrate temperature plays an important role in the control to obtain stable ejection characteristics.

For this purpose, as described in Japanese Patent Laid-Open No. H02-258266 (1990), a conventional inkjet print head is equipped with a temperature sensor built in a substrate for a print head and thus are enabled to read the substrate temperature with high accuracy. This temperature sensor is used to control the ink ejection characteristics that vary due to heat. In addition, using monitor values of the temperature sensor, the inkjet print head forcefully suspends a printing operation for a brief period of time when the substrate temperature rises to an abnormally high degree due to an occurrence of some problem in the substrate. For example, such forceful suspension is performed when the power supply shorts out or when the heater elements are driven under the condition where no ink is left because of any factor (this driving situation is called "blank ejection").

One known temperature sensor has a diode type configuration. Japanese Patent Laid-Open No. 2004-050637 discloses that a diode type of temperature sensor is arranged near a connection terminal (input/output pad) for transmitting and receiving print signals and other signals to and from external units.

To meet a recently-increasing demand for printing at even higher speed, the number of ejection openings and heater elements arranged in a print head has been increasing. In other words, a print head is configured to have a larger print swath by increasing the number of ejection openings and heater elements in an arranging direction (increasing a size or length of a print head). In some cases, however, such length increase causes the temperature distribution in the substrate for the print head to largely vary depending on the driving status of respective heater elements corresponding to the contents of print data or a print mode.

Since the conventional substrate for the print head is relatively small, the temperature sensor is capable of detecting the temperature with sufficiently high accuracy even when being disposed in a position not very close to an array of heater elements, that is, in a position close to a connection terminal. However, as the size of the print head increases, the distance from the temperature sensor to the array of heater elements, especially the array center, increases, thereby making it more difficult to detect the accurate temperature.

As a result, even though it is strongly desirable to dispose the temperature sensor in a position corresponding to the center of the heater element array, the conventional substrate configuration has the following problems.

In the conventional substrate configuration, logic circuits for bringing the heater elements into conduction in response to the drive signals, and logic wirings connected to the logic circuits are disposed. Of these, the logic circuits are formed as an "underlying layer" in a base plate made of Si by a semiconductor manufacturing process, and electrodes and the like for the logic circuits are formed by using an underlying wiring layer. On the other hand, the logic wirings are arranged in parallel in number corresponding to the number of heater elements. Accordingly, the number of logic wirings increases as the number of heater elements increases. Because the underlying wiring layer allows size reduction in the width of wirings and the spaces between the wirings, the underlying wiring layer is also used to form the logic wirings. When a functional element such as a diode sensor, for example, is used as the temperature sensor, the functional element is also formed by the semiconductor manufacturing process as in the case of the logic circuits. Thus, the functional element is also formed by using the underlying wiring layer. Instead, the sensor may be formed by using a wiring or the like as a resistor. In this case, the resistance value of the wiring or the like needs to be locally increased to a sufficiently high level for achieving high detection sensitivity. To form such sensor, it is also desirable to use the underlying wiring layer that allows size reduction in the width of lines and the spaces between the lines.

As described above, even if the temperature sensor is attempted to be disposed in a position corresponding to the center of the heater element array, the logic circuits and the logic wirings are located around the heater element array and therefore, the temperature sensor is disposed at an outer side of these circuits and wirings. As a result, the substrate size in a width direction is increased by an area of the temperature sensor. Consequently, problems arise that the number of substrates manufactured from a single Si wafer is reduced, thereby increasing costs for the substrates.

SUMMARY OF THE INVENTION

The present invention has been made in consideration of the foregoing problems. An object of the present invention is to enable accurate temperature detection even for a long substrate including a large number of heater elements, while preventing an increase in the width of the substrate which would accompany the placement of a temperature sensor.

In an aspect of the present invention, there is provided a substrate for an inkjet head comprising: M×N energy generating elements for generating energy utilized to eject ink, arranged in an array, and divided into N blocks for performing time-divisional driving; and M signal lines for selecting energy generating elements to be driven in each of the N blocks, wherein the M signal lines include L signal lines (L<M) and (M−L) signal lines, the L signal lines for selecting, from the energy generating elements, L energy generating elements closest to an one end side of the substrate with respect to an arrangement direction of the energy generating elements, extending in the arrangement direction from a start point that is a portion in the one end side toward another end side of the substrate in the arrangement direction, the (M−L) signal lines for selecting, from the energy generating elements, (M−L) energy generating elements closest to the other end side from the energy generating elements, extending in the arrangement direction from a start point that is a portion at the other end side toward the one end side, wherein a number of the L signal lines crossing an intersecting direction intersecting the arrangement direction and a number of the (M−L) signal lines crossing the intersecting direction are decremented as distances from respective the start points increase, and with the decrement in the numbers of the signal lines, the L signal lines and the M−L signal lines are arranged so that the remaining signal lines are shifted toward the energy generating elements, and wherein a temperature sensor for detecting a temperature of the substrate is provided in an empty area produced by the shift of the signal lines.

In another aspect of the present invention, there is provided an inkjet head comprising: a substrate as the above; and a member provided in contact with the substrate, and provided with ejection openings for ejecting ink by action of the energy generated by the energy generating elements.

According to the present invention, accurate temperature detection can be performed even for a long substrate including a large number of printing elements and at the same time, an increase in the width of the substrate is prevented even though such increase would otherwise occur due to the placement of a temperature sensor.

Further features of the present invention will become apparent from the following description of exemplary embodiments (with reference to the attached drawings).

DESCRIPTION OF THE EMBODIMENTS

Hereinafter, the present invention will be described in detail with reference to the drawings.

1. First Embodiment (1) Printing Apparatus

Figure 1:
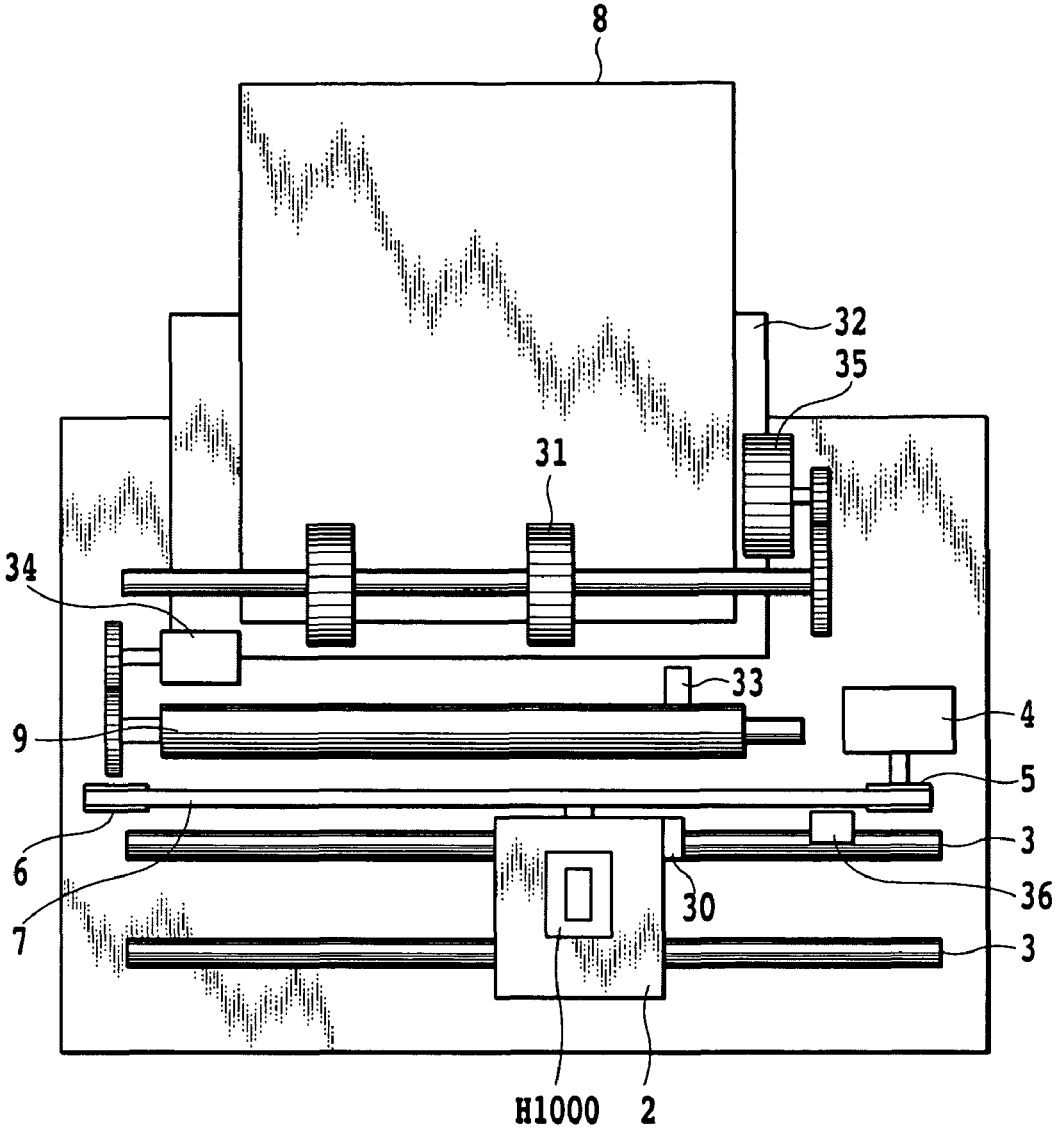
FIG. 1 is a schematic plan view showing one example of a printing apparatus on which a print head according to an embodiment of the present invention is mountable.

FIG. 1 is a schematic plan view showing one example of a printing apparatus on which a print head according to an embodiment of the present invention is mountable.

In the printing apparatus shown in FIG. 1, a print head including a print element unit to be described later is configured as a cartridge type print head (hereinafter, referred to as a print head cartridge) in combination with a container containing ink that is detachably or undetachably attached to the print head. The print head cartridge H1000 is positioned in and thus is removably mounted on a carriage 2. The carriage 2 is provided with an electric connector for transmitting drive signals and the like to the print element unit through an external signal input terminal on the print head cartridge H1000.

The carriage 2 is supported as being capable of reciprocating along guide shafts 3, which are provided to an apparatus body, and which extend in a main-scan direction. The carriage 2 is driven by a main scanning motor 4 through a driving mechanism including a motor pulley 5, a driven pulley 6, a timing belt 7 and the like. Also, the position and the movement of the carriage 2 are controlled by the main scanning motor 4 through the driving mechanism. Moreover, a home position sensor 30 is provided to the carriage 2. In this configuration, the position of the carriage 2 is detected when the home position sensor 30 on the carriage 2 passes by the position of a shielding plate 36.

Print media 8 such as a print sheet or a plastic thin film are supplied separately one by one from an automatic sheet feeder (ASF) 32 by rotating pickup rollers 31 with a driving force of a sheet supply motor 35. Here, the driving force is transmitted to the pickup rollers 31 through a transmission mechanism such as gears. Then, with rotation of a conveyance roller 9, the print medium 8 is conveyed (sub-scanned) through a position (printing region) facing an ejection opening forming face of the print head cartridge H1000. The conveyance roller 9 is rotated by receiving a driving force transmitted from an LF motor 34 through a transmission mechanism such as gears. At this time, a paper end sensor 33 detects the front end of the print medium 8 to judge whether or not the print medium 8 is fed, and to determine a print start position on the print medium. Moreover, the paper end sensor 33 is used to detect where the rear end of the print medium 8 actually is positioned, and thus the paper end sensor 33 is also used for finally determining the current printing position according to the actual position of the rear end.

Incidentally, the print medium 8 is supported on its back side by a platen (not illustrated) so as to form a flat print face in the printing region. On the other hand, the print head cartridge H1000 mounted on the carriage 2 is held so that the ejection opening forming face thereof is projected downward from the carriage 2 and is located in parallel with the surface of the print medium 8. Moreover, the print head cartridge H1000 is mounted on the carriage 2 so that an array direction of ejection openings in the print element unit intersects the main scanning direction of the carriage 2.

(2) Print Element Unit

Figure 2:
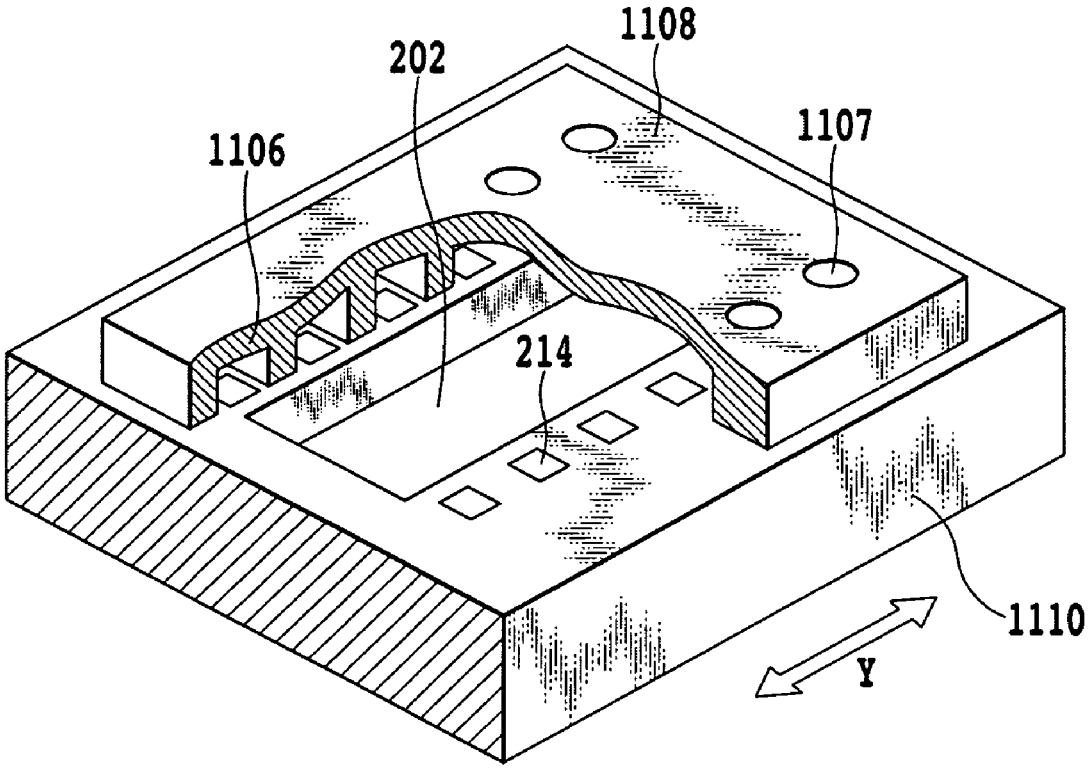
FIG. 2 is a schematic perspective view showing a configuration example of a print element unit applied to a print head mounted on the printing apparatus in FIG. 1.

FIG. 2 is a schematic perspective view showing a configuration example of the print element unit applied to the print head cartridge H1000. A substrate 1110 constituting the print element unit is formed of Si in a thickness of 0.5 mm to 1 mm, and is provided with an ink supply opening 202 that is a through-hole in a long groove shape and serves as an ink channel. Ink is introduced to this ink supply opening 202. Two arrays of heater elements 214 serving as ejection energy generating portions are provided, one at either side of the ink supply opening 202. The arrays are positioned in such a staggered arrangement that the heater elements 214 in one of the arrays are shifted by ½ pitch from those of the other array in a Y direction. Electrodes for electrically connecting the heater elements and the logic circuits to the outside are formed along two sides of the substrate 1110 in a direction crossing the array direction of the heater elements 214 (this will be described later). Moreover, a component 1108 is provided in contact with the substrate 1110. The component 1108 includes liquid paths formed by ink channel walls 1106, and ink ejection openings 1107 that communicate with the liquid paths and is used to eject ink to a print medium with the action of thermal energy.

Incidentally, as a print element for generating energy used to eject ink, any type of print element is usable, including a heater element that generates thermal energy for heating ink to form bubbles in response to conduction. However, as the type of print element using the heater element receives such a great influence of heat generated during the driving of the heater element, the present invention is preferably applicable to this type of print element.

In addition, although FIG. 2 only schematically shows the heater elements 214 and the ejection openings 1107, the print element unit may be formed to have 288 heater elements at either side of the ink supply opening 202 in practice. The 288 heater elements are divided by 24 elements into 12 blocks (the dividing number is N=12). Then, the print element unit can be configured such that one of the heater elements of each block (24 heater elements in total) can be driven at one timing (the number of heater elements simultaneously drivable in one driving operation is M=24)

(3) Configuration Example of Drive Circuit

Figure 3:
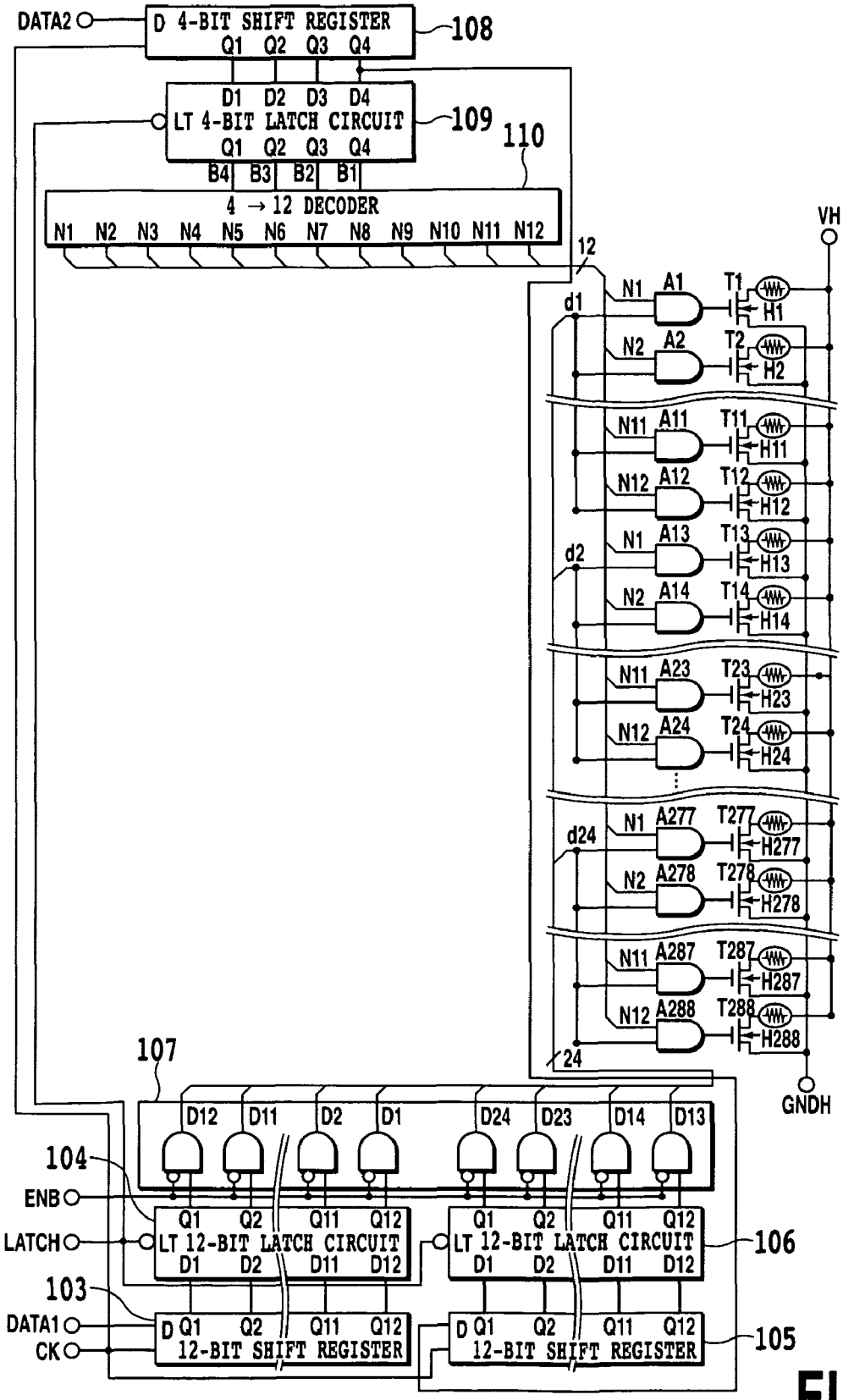
FIG. 3 is a block diagram showing a configuration example of a drive circuit that is formed on a substrate constituting the print element unit in FIG. 2, and includes logic circuits.

FIG. 3 is a block diagram showing a configuration example of a drive circuit being formed on the substrate 1110 and including logic circuits. This drive circuit is formed on a silicon (Si) substrate by using film formation techniques and the like.

The shown drive circuit is configured to provide print signals D1 to D24 and block control signals B1 to B4 to the print element unit through shift registers and latch circuits. As shown in FIG. 3, a print signal DATA1 and a print signal DATA2 are provided from a printer main body, and the print signal DATA1 includes the print signals D1 to D12 whereas the print signal DATA2 includes the print signals D13 to D24 and the block control signals B1 to B4.

In FIG. 3, reference numeral 103 indicates a 12-bit shift register to which the print signal DATA1 is serially inputted in synchronization with clock signals CK provided from the printer main body. Reference numeral 104 indicates a 12-bit latch circuit that latches 12 bits of the print signals D1 to D12 aligned in the 12-bit shift register 103, in response to latch signals LATCH provided from the printer main body. Reference numeral 108 indicates a 4-bit shift register to which the print signals DATA2 is serially inputted in synchronization with the clock signals CK provided by the printer main body. Reference numeral 105 indicates a 12-bit shift register to which the print signals D13 to D24 of the print signals DATA2 shifted and outputted from the shift register 108 are serially inputted in synchronization with the clock signals CK provided by the printer main body. Reference numeral 106 indicates a 12-bit latch circuit that latches 12 bits of the print signals D13 to D24 aligned in the 12-bit shift register 105, in response to the latch signals LATCH provided by the printer main body.

Reference numeral 109 indicates a 4-bit latch circuit that latches 4 bits of the block control signals B1 to B4 stored in the 4-bit shift register 108, in response to the latch signals LATCH provided by the printer main body. Reference numeral 107 indicates an AND circuit that calculates the logical AND between an enable signal ENB and each of 24 bits of the print signals latched by the 12-bit latch circuit 104 and the 12-bit latch circuit 106.

Reference numeral 110 indicates a decoder that decodes the block control signals Bi to B4 provided by the printer main body to generate block selection signals N1 to N12. Reference numerals H1 to H288 indicate heater elements. In addition, reference numerals T1 to T288 indicate switching transistors for powering on/off the heater elements H1 to H288, respectively. Reference numerals A1 to A288 indicate AND circuits connected to the bases of the transistors T1 to T288, respectively. The AND circuits A1 to A288 calculate the logical ANDs between each of outputs from the AND circuit 107 based on the print signals D1 to D24 inputted by the printer main body, and each of the block selection signals N1 to N12 outputted by the decoder 110. In other words, based on the selections indicated by the block selection signals N1 to N12, the outputs from the AND circuit 107 are provided as the drive signals dl to d24 to the bases of the transistors T1 to T288, whereby the heater elements H1 to H288 are selectively powered on. Here, the timings of driving the heater elements H1 to H288 are determined in response to the block selection signals N1 to N12.

In this embodiment, the drive signals d1 to d24 are signals provided to the respective groups of 12 heater elements arranged continuously in space. On the other hand, the block selection signals N1 to N12 are signals that determine which of the 12 heater elements in each of the groups is to be driven. To put it differently, the "block" is not composed of heater elements arranged continuously in space, but is composed of every twelfth heater elements arranged in the whole array. More specifically, the heaters H1, H13, H25, . . . , H277, for example, forms one block of heaters to be simultaneously driven.

The width of a drive signal (drive pulse width) outputted by the AND circuit 107 is defined by an enable signal ENB inputted to one of input terminals of the AND circuit 107. Incidentally, in the illustrated example, the enable signal ENB is of negative logic. Thus, the AND circuit 107 is configured to output the drive signal when the logic state of the enable signal ENB is "low."

Moreover, in the configuration shown in FIG. 3, the following seven signal lines including a supply line for a power supply voltage (VH) and a signal line of a ground voltage (GNDH) are provided between the drive circuit and the printer main body. Specifically, the seven signal lines are for the print signal DATA1, the print signal DATA2, the clock signal CK, the enable signal ENB, the latch signal LATCH, the power supply voltage VH and the ground voltage GNDH.

Together with the heater elements H1 to H288 and the transistors A1 to A288 for power on/off control, the drive circuit illustrated in this embodiment is formed on the same substrate (for example, a silicon substrate) by using semiconductor manufacturing processes, thereby forming the substrate for the print head.

(4) Layout of Drive Circuit

Figure 4:
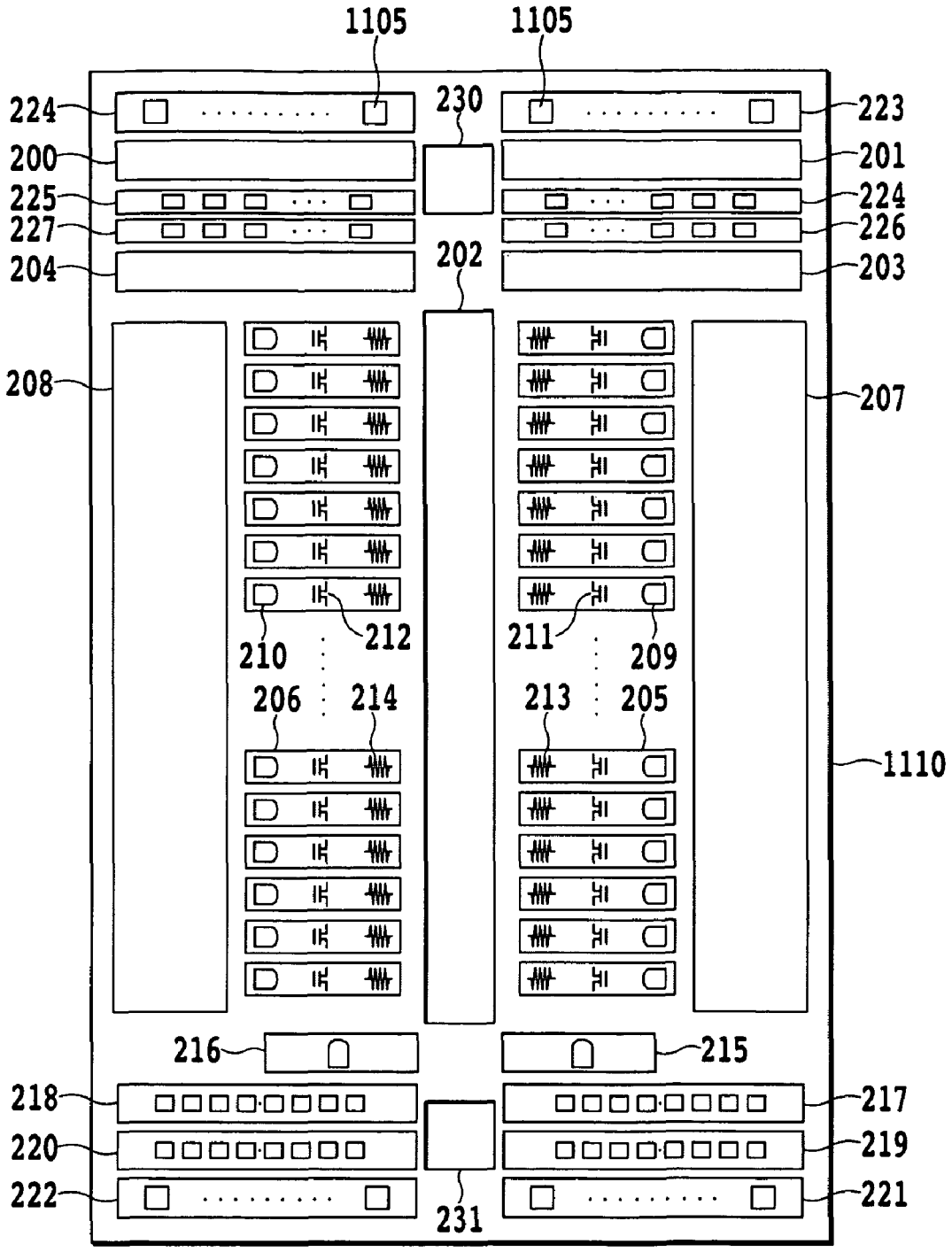
FIG. 4 is a schematic diagram showing a basic layout in the case where the drive circuit in FIG. 3 is built in a substrate.

FIG. 4 is a schematic diagram showing a basic layout in the case where the drive circuit is formed on the substrate. The configuration shown in FIG. 4 includes two of the drive circuits shown in FIG. 3 arranged approximately in line symmetry with respect to the ink supply opening 202. Incidentally, in general, multiple drive circuits are formed on one substrate such as a silicon (Si) wafer at one time, and then the substrate 1110 shown in FIG. 2 is obtained by dividing the substrate into pieces.

Reference numerals 221, 222, 223 and 224 indicate regions where terminals 1105 for connecting signal lines connecting the printer main body and the print element unit are arranged appropriately. These signal lines are for transmitting the print data DATA1 and DATA2, the latch signal LATCH, the clock signal CK, the enable signal ENB, the power supply voltage VH and the ground voltage GNDH to each of the drive circuits provided at both sides of the ink supply opening 202. Here, the print data DATA1 are connected to terminals located in the regions 221 and 222, while the print data DATA2 are connected to terminals located in the regions 223 and 224.

Reference numerals 219 and 220 indicate regions where the 12-bit shift registers 103 are formed for the respective drive circuits provided at both sides of the ink supply opening 202. Reference numerals 224 and 225 indicate regions where the 4-bit shift registers 108 and the 12-bit shift registers 105 are formed for the respective drive circuits provided at both sides of the ink supply opening 202. Reference numerals 217 and 218 indicate regions where the 12-bit latch circuits 104 are formed for the respective drive circuits provided at both sides of the ink supply opening 202. Reference numerals 226 and 227 indicate regions where the 4-bit latch circuits 109 and the 12-bit latch circuits 106 are formed for the respective drive circuits provided at both sides of the ink supply opening 202.

Reference numerals 215 and 216 indicate regions where the AND circuits 107 are formed for the respective drive circuits provided at both sides of the ink supply opening 202, and reference numerals 203 and 204 indicate regions where the decoders 110 are formed similarly for the respective drive circuits. Reference numeral 209 and 210 indicate regions where the AND gates A1 to A288 are formed for the respective drive circuits provided at both sides of the ink supply opening 202, and reference numeral 211 and 212 indicate regions where the power transistors T1 to T288 are formed similarly for the respective drive circuits. Reference numeral 213 and 214 indicate regions where the heater elements H1 to H288 are formed for the respective drive circuits provided at both sides of the ink supply opening 202, and reference numeral 207 and 208 indicate wiring regions where the signal lines and the like for transmitting various kinds of signals d1 to d24, N1 to N12 and B1 to B4 are formed similarly for the respective drive circuits.

Reference numerals 200 and 201 indicate regions where voltage step-up circuits are formed for enhancing the driving capabilities of the transistors in the respective regions 211 and 212. The voltage step-up circuit is used to increase the drive voltage of the logic circuit to provide each of the transistors with a gate voltage larger than the drive voltage. Reference numeral 202 indicates a supply opening region for supplying ink to the heater elements H1 to H288 from the reverse side of the substrate. Reference numeral 205 and 206 indicate regions each including a set of one heater element, one transistor and one AND gate. Here, the transistor and AND gate are formed corresponding to the heater element.

Reference numerals 230 and 231 indicate diode temperature sensors provided at both end sides of the heater element arrays. In this embodiment, a diode temperature sensor is further provided in a position corresponding to the center of each of the heater element arrays, thereby improving the accuracy of temperature detection. In this embodiment for this case, a region for arranging the temperature sensor is secured within each of the regions 207 and 208 in the foregoing drive circuit layout by appropriately arranging wirings of the signal lines for transmitting the drive signals d1 to d24 to the respective groups of heater elements.

Figure 5:
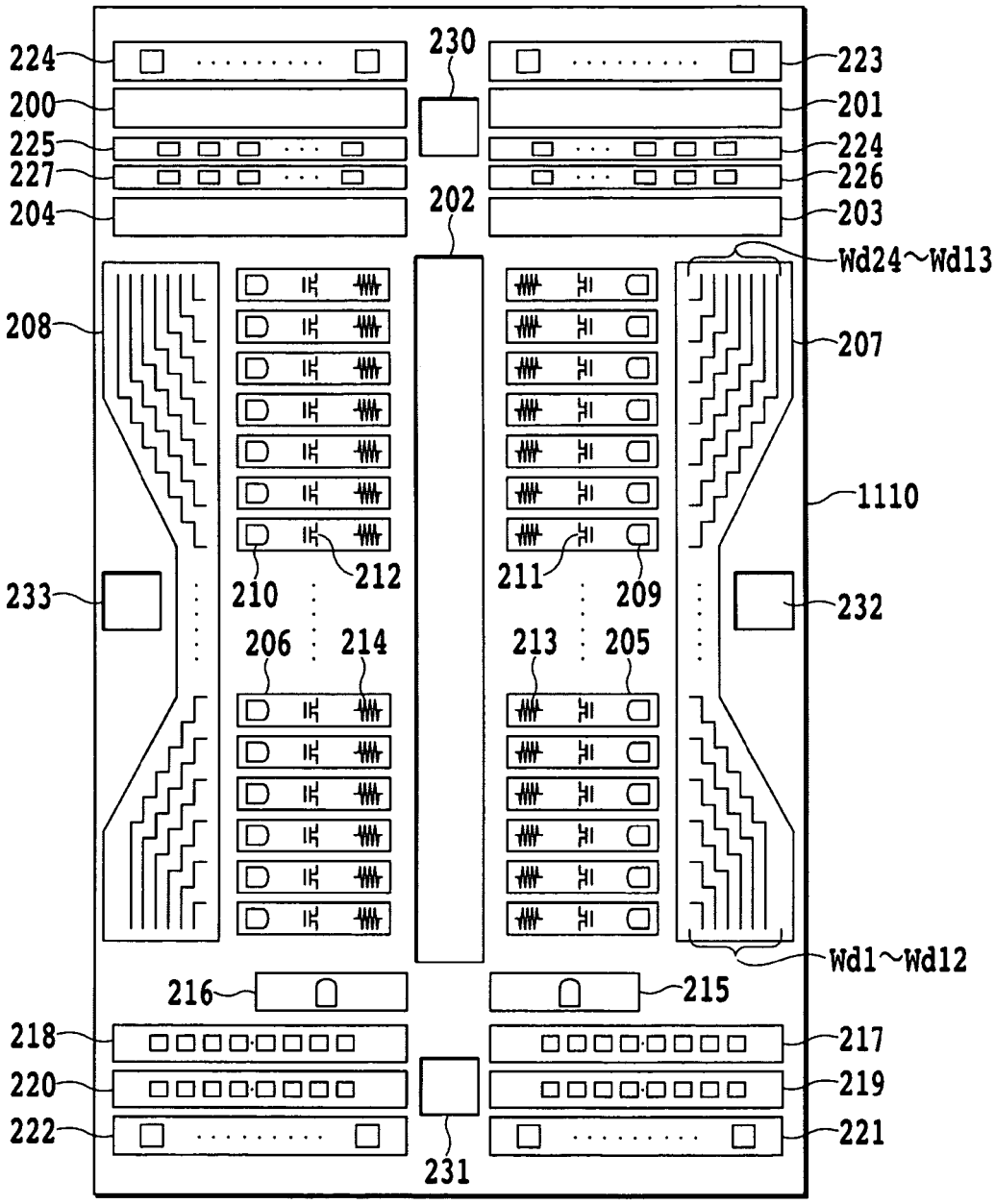
FIG. 5 is a schematic diagram according to the first embodiment of the present invention and showing a wiring of signal lines for transmitting drive signals and a placement of temperature sensors within a region in the layout of FIG. 4.

FIG. 5 shows a wiring state of the signal lines for transmitting the drive signals d1 to d24 within the regions 207 and 208 in the layout in FIG. 4 according to the first embodiment of the present invention.

Here, reference numeral Wd1 indicates a signal line for transmitting the drive signal d1, and is connected to the heater elements H1 to H12 (a group including first to twelfth heater elements from the lowermost side in FIG. 5). Reference numeral Wd2 indicates a signal line for transmitting the drive signal d2, and is connected to the heater elements H13 to H24 (a group including thirteenth to twenty-fourth heater elements from the lowermost side in FIG. 5, similarly). The connection relationships between the other following-numbered signal lines and heater elements are defined in the same manner as described above. Thus, a signal line Wd12 is connected to heater elements H133 to H144 (a group including 133rd to 144th heater elements from the lowermost side in FIG. 5).

Also, reference numeral Wd24 indicates a signal line for transmitting the drive signal d24, and is connected to the heater elements H288 to H277 (a group including first to twelfth heater elements from the uppermost side in FIG. 5). Reference numeral Wd23 indicates a signal line for transmitting the drive signal d23, and is connected to the heater elements H276 to H255 (a group including thirteenth to twenty-fourth heater elements from the uppermost side in FIG. 5, similarly). The connection relationships between the other following-numbered signal lines and heater elements are defined in the same manner as described above. Thus, a signal line Wd13 is connected to heater elements H156 to H145 (a group including 133rd to 144th heater elements from the uppermost side in FIG. 5).

In the aforementioned layout, the signal lines Wd1 to Wd12 are formed such that the number of signal lines crossing an intersecting direction intersecting (orthogonally intersecting, in this embodiment) a direction in which the heater element are arranged decreases with the decrease in the distance to the center of the heater element array. More specifically, the signal line Wd1 is not formed out of a region for the first group of 12 heater elements from the lowermost side in FIG. 5, the signal line Wd2 is not formed out of a region for the first and further second groups of 12 heater elements from the lowermost side in FIG. 5. Thus, only the signal line Wd12 is eventually formed in a region for the group of 12 heater elements closest to the center of the heater element array. On the other hand, the number of the signal lines Wd24 to Wd13 also decreases with the decrease in the distance to the center of the heater element array. More specifically, the signal line Wd24 is not formed out of a region for the first group of 12 heater elements from the uppermost side in FIG. 5, the signal line Wd23 is not formed out of a region for the first and further second groups of 12 heater elements from the uppermost side in FIG. 5. Thus, only the signal line Wd13 is eventually formed in a region for the group of 12 heater elements closest to the center of the heater element array.

In this embodiment, with attention focused on the foregoing layout, the wiring configuration of the signal lines Wd1 to Wd12 and Wd24 to Wd13 is appropriately determined as shown in FIG. 5. In other words, each of the signal lines is arranged not to linearly extend in a direction along the heater element array. To be more precise, instead of it, the number of signal lines is decremented by one as the distance from each start point of signal lines increases. Here, the start point is located in the proximity of each of both ends of the heater element array in the array direction. Thus, the signal lines are arranged in a staircase pattern in which, with the decrement in the number of signal lines crossing the above intersecting direction, the remaining signal lines are shifted toward the heater element array and thereby come close to the heater element array.

In this wiring configuration, each of the regions 207 and 208 includes an empty region, which is surrounded on three sides by the signal lines, around the center of the heater element array. Thus, the diode temperature sensors 232 and 233 are respectively arranged in these regions. Even when the temperature of the print element unit or the print head rises due to heat generated by the heater elements with the progress of a printing operation and the like, this configuration allows accurate detection of the temperature and enables control for obtaining the stable ejection characteristics.

Moreover, since the temperature sensor can be arranged within the region 207, the substrate size does not increase in the width direction (in the lateral direction in FIGS. 4 and 5). This avoids a problem of decreasing the number of substrates manufactured from a single wafer, and thereby prevents an increase in costs for substrates.

Figure 6:
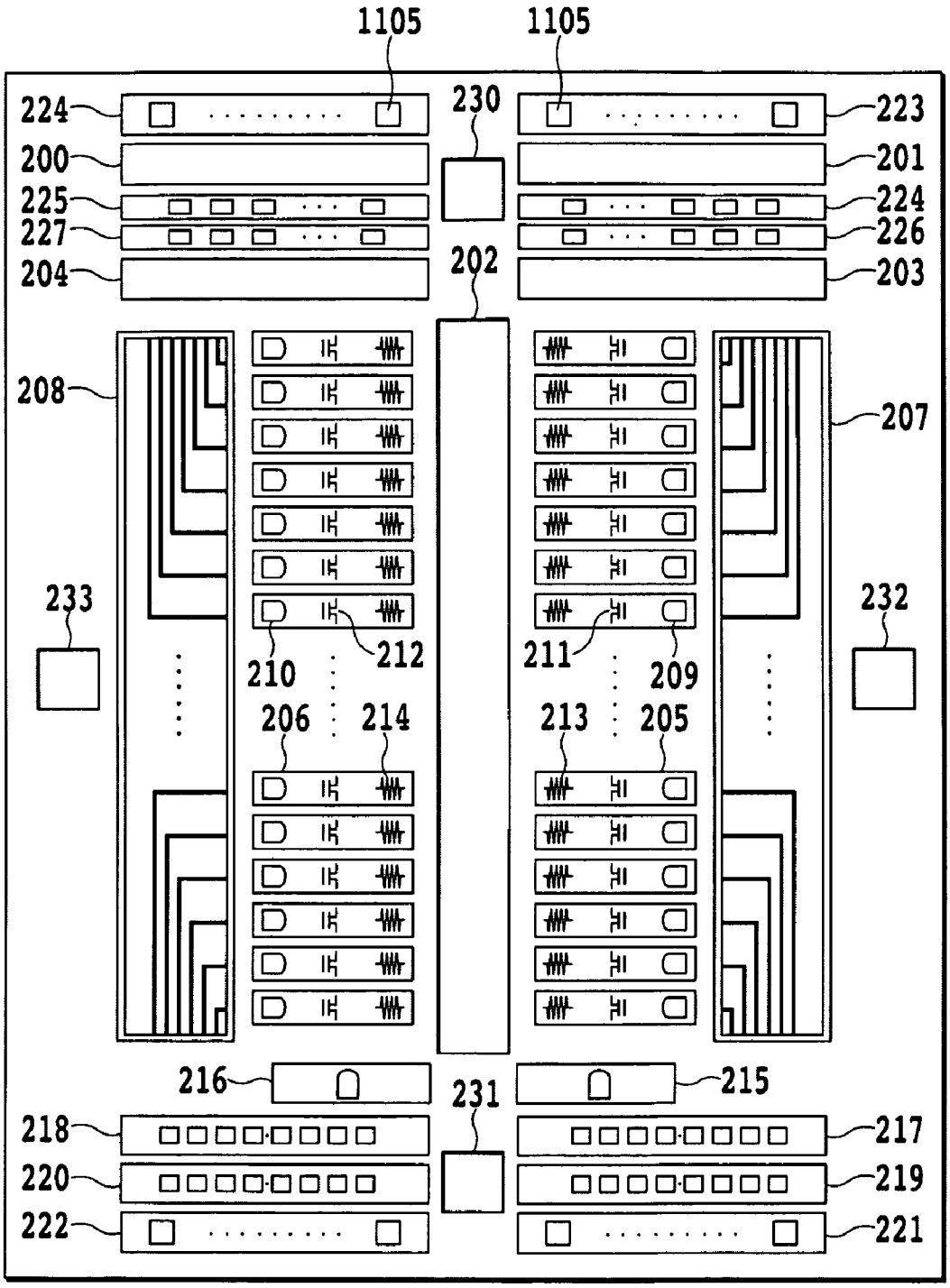
FIG. 6 is a schematic diagram showing a comparative example in relation to the configuration in FIG. 5.

In contrast, in the case where the wiring configuration of the drive signal lines is not considered at all unlike this embodiment, for example, the signal lines are arranged to linearly extend in the direction along the heater element array, and then respective signal lines are wired so as to bend with respect to respective heater elements, as shown in FIG. 6. In such a case, each of the regions 207 and 208 becomes a rectangular region in which the signal lines are wired, along the heater element array. For this reason, when locating the temperature sensors at central portions of the substrate, the respective temperature sensors are inevitably arranged at the outer side of the regions 207 and 208. That is to say, in this case, the substrate size increases in the width direction, which in turn decreases the number of substrates manufactured from a single wafer and leads to an increase in costs for substrates.

(5) Modified Example

In the embodiment shown in FIG. 5, the signal lines are arranged in the staircase pattern in which, every time the number of signal lines is decremented by one, the remaining signal lines are shifted toward the heater element array and thereby come close to the heater element array. As the wiring configuration, however, any configuration can be employed as long as the configuration certainly provides an area for arranging the temperature sensor in the region 207. For instance, each of the signal lines may be arranged to linearly extend from the start point in the proximity of one end of the heater element array, to the heater element group to which the signal line is connected, i.e., the signal line may be arranged in a direction of an oblique line in FIG. 5.

In the foregoing example, the heater element arrays are provided at both sides of the ink supply opening 202 and the temperature sensors are provided to the respective heater element arrays. If temperature detection with desired accuracy is possible, providing of one temperature sensor to only one of the heater element arrays may be sufficient. In addition, the present invention is effectively applicable to even a case where the heater element array is arranged at only one side of the ink supply opening 202.

Moreover, in the foregoing example, the number of heater elements targeted by one temperature sensor for temperature detection is set to 288 and the M=24 print elements are simultaneously can be driven at one driving timing. These heater elements are divided at the center of the array into two groups of 144 heater elements, and drive signals of M/2=12 bits are provided to the two groups, respectively, from opposite side portions of the substrate. However, the number of heater elements arranged and the dividing position of the heater elements may be determined as desired. More specifically, when M signal lines (also referred to as 'M bits of drive signals', hereinafter) are divided into L signal lines (also referred to as 'L bits of drive signals', hereinafter) for L-bit signal lines for selecting L heater elements, and (M−L) signal lines (also referred to as '(M−L) bits of drive signals', hereinafter) for (M−L)-bit signal lines, M and L do not always have to satisfy L=M−L, i.e., L=M/2. The number L can be appropriately determined as long as a desired level of accuracy is achieved. Alternatively, if M is an odd number, L can be selected so as to satisfy L≈M−L, i.e., L≈M/2. In other words, a temperature sensor can be provided to a position near the center of the heater element array, instead of a position at the exact center of the heater element array, within a range where the temperature sensor can achieve a desired level of accuracy. The "substantial center of an array area" includes such cases. Incidentally, M and L are natural numbers.

Moreover, the foregoing example shows that the temperature sensor is configured of a diode, but the present invention is not limited to this.

Figure 7:
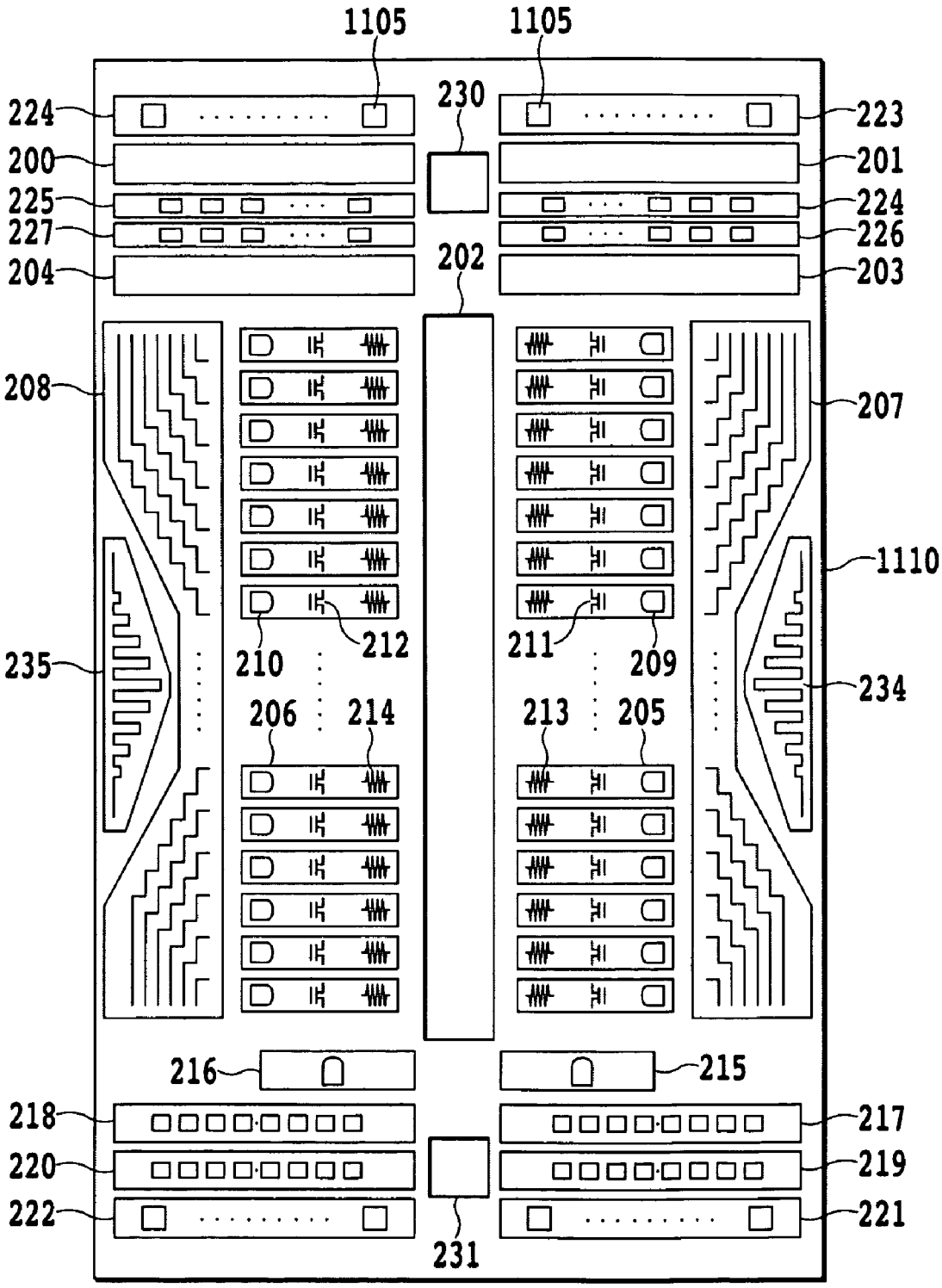
FIG. 7 is a schematic diagram according to a modified example of the first embodiment of the present invention and showing a wiring of signal lines for transmitting drive signals and a placement of temperature sensors within a region in the layout in FIG. 4.
Figure 8:
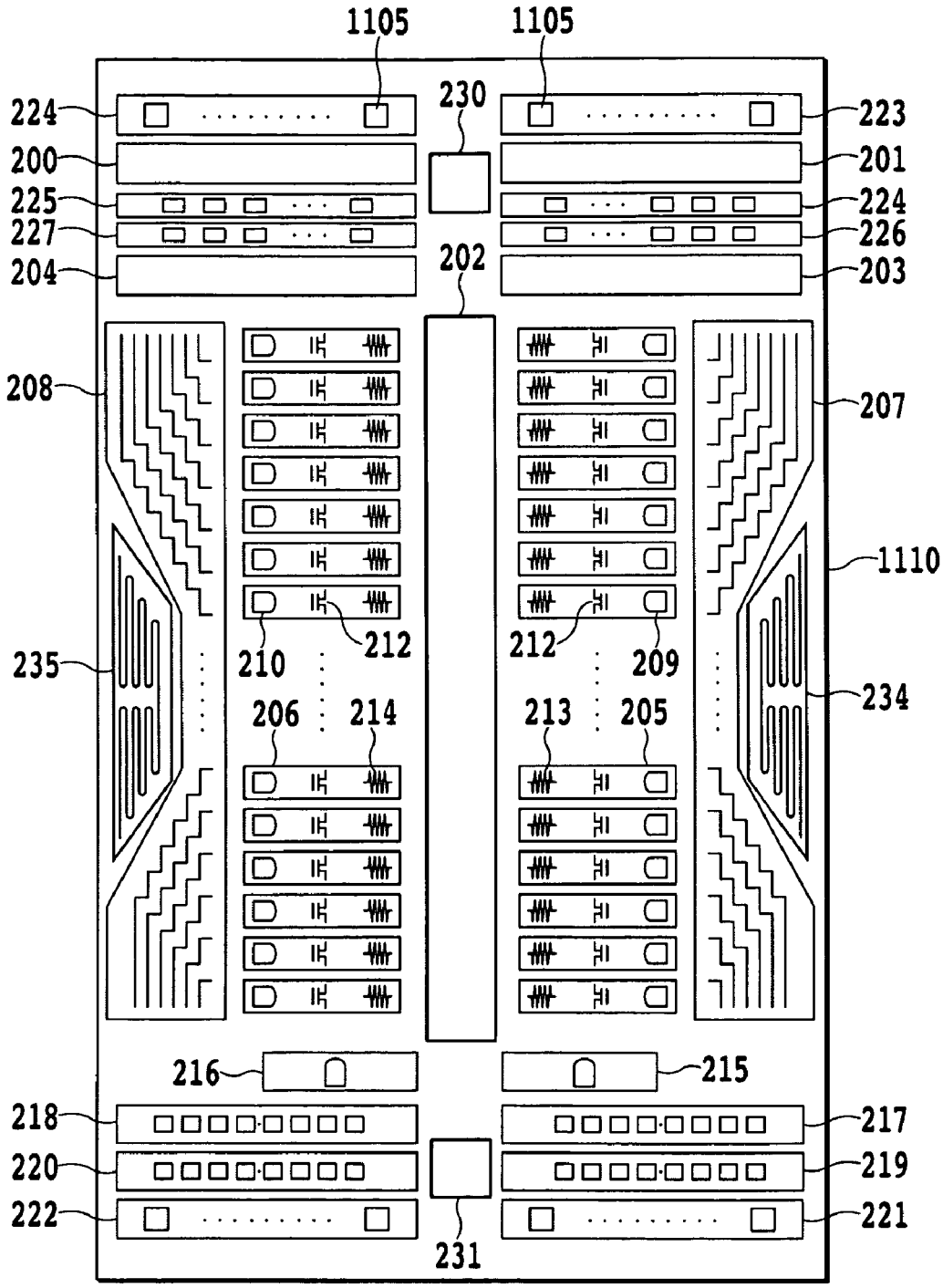
FIG. 8 is a schematic diagram according to another modified example of the first embodiment of the present invention and showing a wiring of signal lines for transmitting drive signals and a placement of temperature sensors within a region in the layout in FIG. 4.

Each of FIGS. 7 and 8 shows an example in which temperature sensors 234 and 235 are formed by use of a wiring layer. When a temperature sensor is formed by use of a wiring layer, it is desirable to form a sensor wiring with a small width or to form the wiring in a meandering shape as shown in FIGS. 7 and 8. The sensor wiring thus formed has higher resistance than other regions. In this case, the temperature detection accuracy is improved, because the higher the resistance, the larger the change in the resistance due to the temperature characteristic. Further, the thickness of the wiring may be reduced instead of, or in addition to, making the width of the wiring thinner.

Although various materials are usable for the wiring layer to form the temperature sensor, one of desirable materials is the same material as that used for the wirings of the drive circuit. For example, aluminum is desirable.

2. Second Embodiment

The foregoing first embodiment provides the description of the configuration in which: the single ink supply opening 202 is provided in the substrate; and the heater elements are arranged at both sides of the ink supply opening 202. Alternatively, the present invention is also applicable to a substrate provided with two or more ink supply openings.

Figure 9:
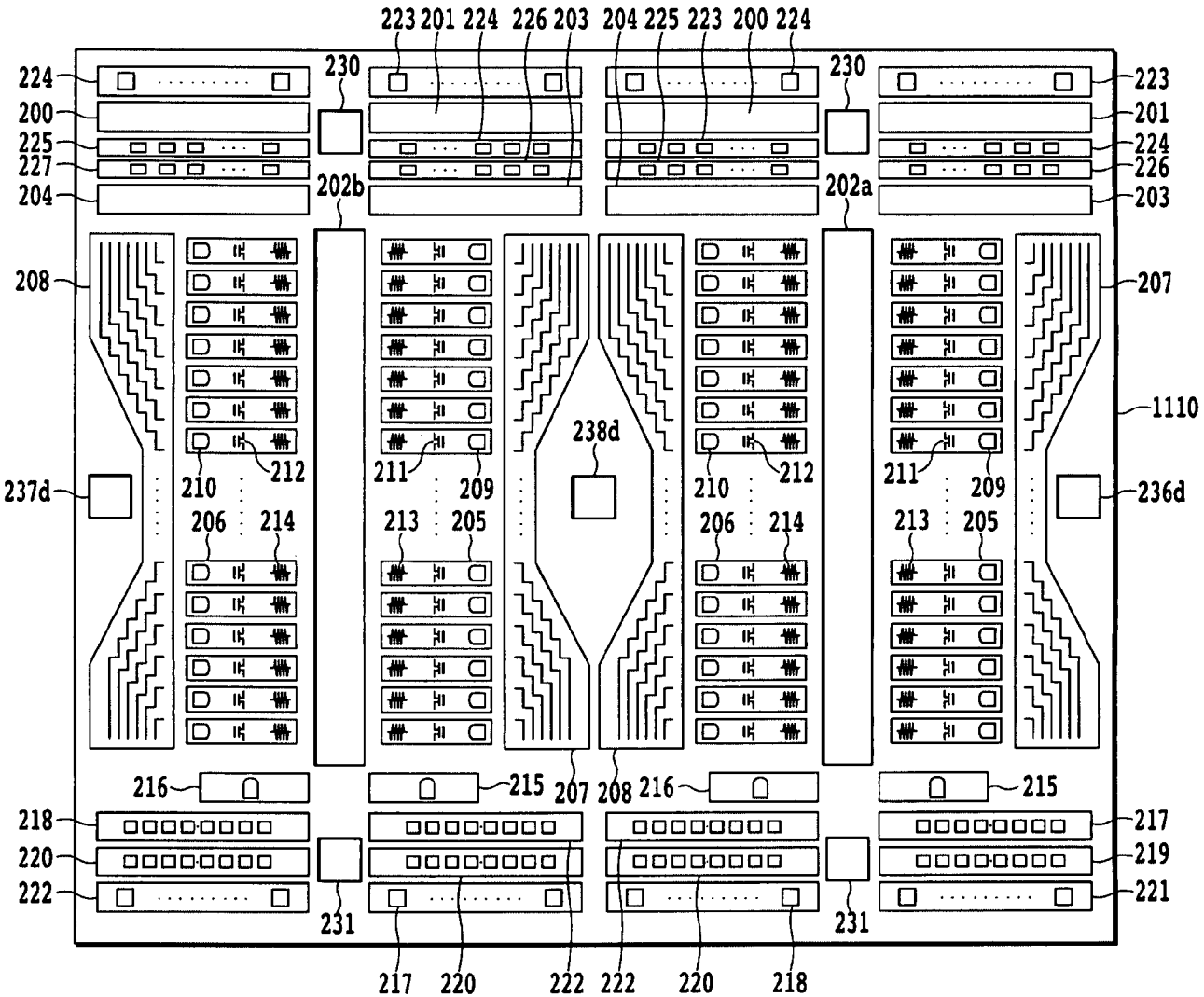
FIG. 9 is a schematic diagram according to a second embodiment of the present invention and showing a wiring of signal lines for transmitting drive signals and a placement of temperature sensors.

FIG. 9 is a schematic diagram showing a layout of driving circuits and the like on a substrate provided with two ink supply openings according to a second embodiment of the present invention. As similar to the foregoing example, heater elements are arranged at both sides of each of ink supply openings 202*a* and 202*b*. Incidentally, the two ink supply openings 202*a* and 202*b* may be provided for a single color ink or may be provided respectively for inks with different tones (colors, densities).

A diode temperature sensor is provided in a position corresponding to the substantial center of each of the heater element arrays as in the case of the first embodiment. Incidentally, although FIG. 9 shows a case where a single temperature sensor 238*d* is provided in common to the heater element array at the left side of the ink supply opening 202*a* and the heater element array at the right side of the ink supply opening 202*b*, two temperature sensors may be provided respectively to these two heater element arrays.

Figure 10:
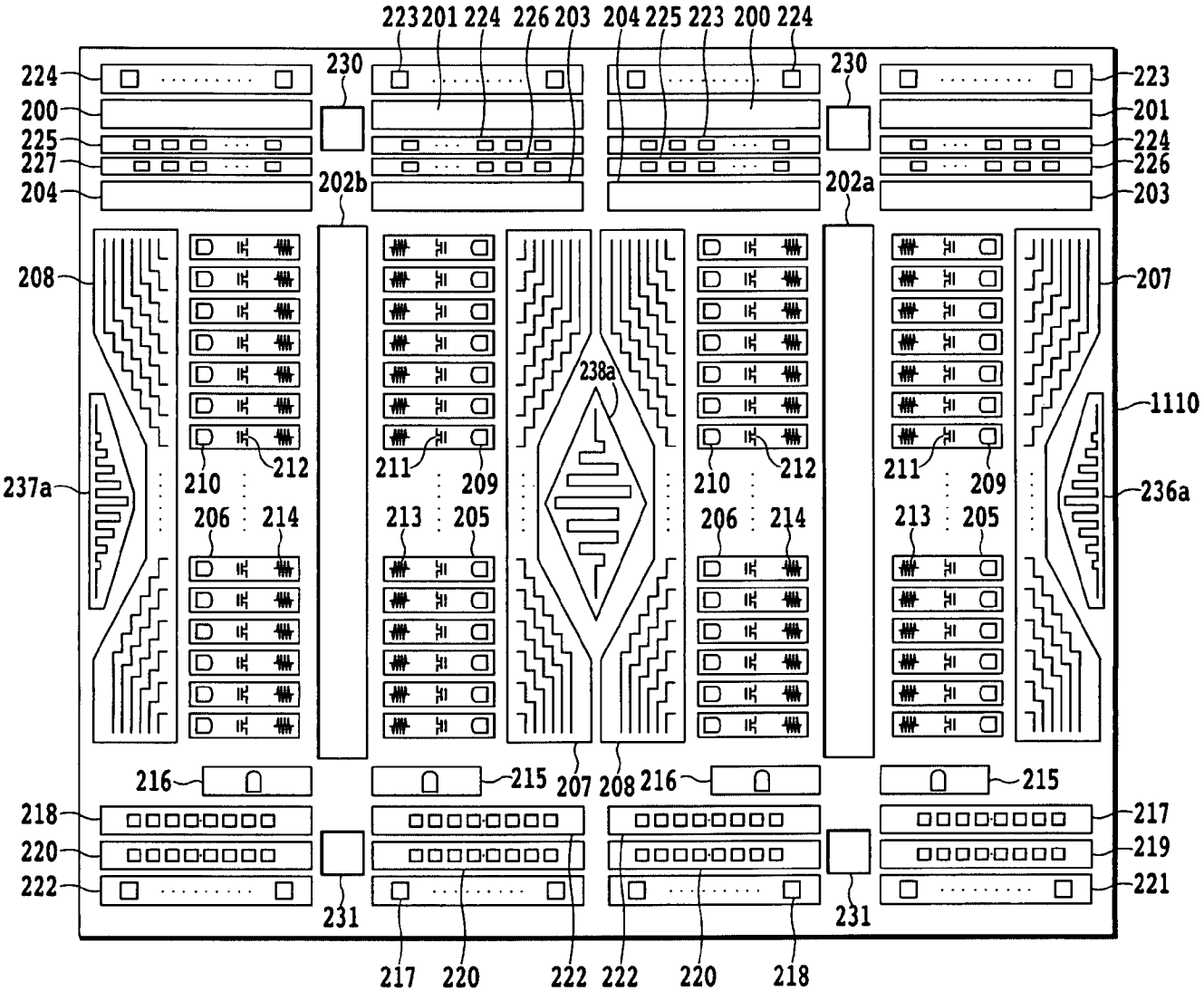
FIG. 10 is a schematic diagram according to a modified example of the second embodiment of the present invention and showing a wiring of signal lines for transmitting drive signals and a placement of temperature sensors.
Figure 11:
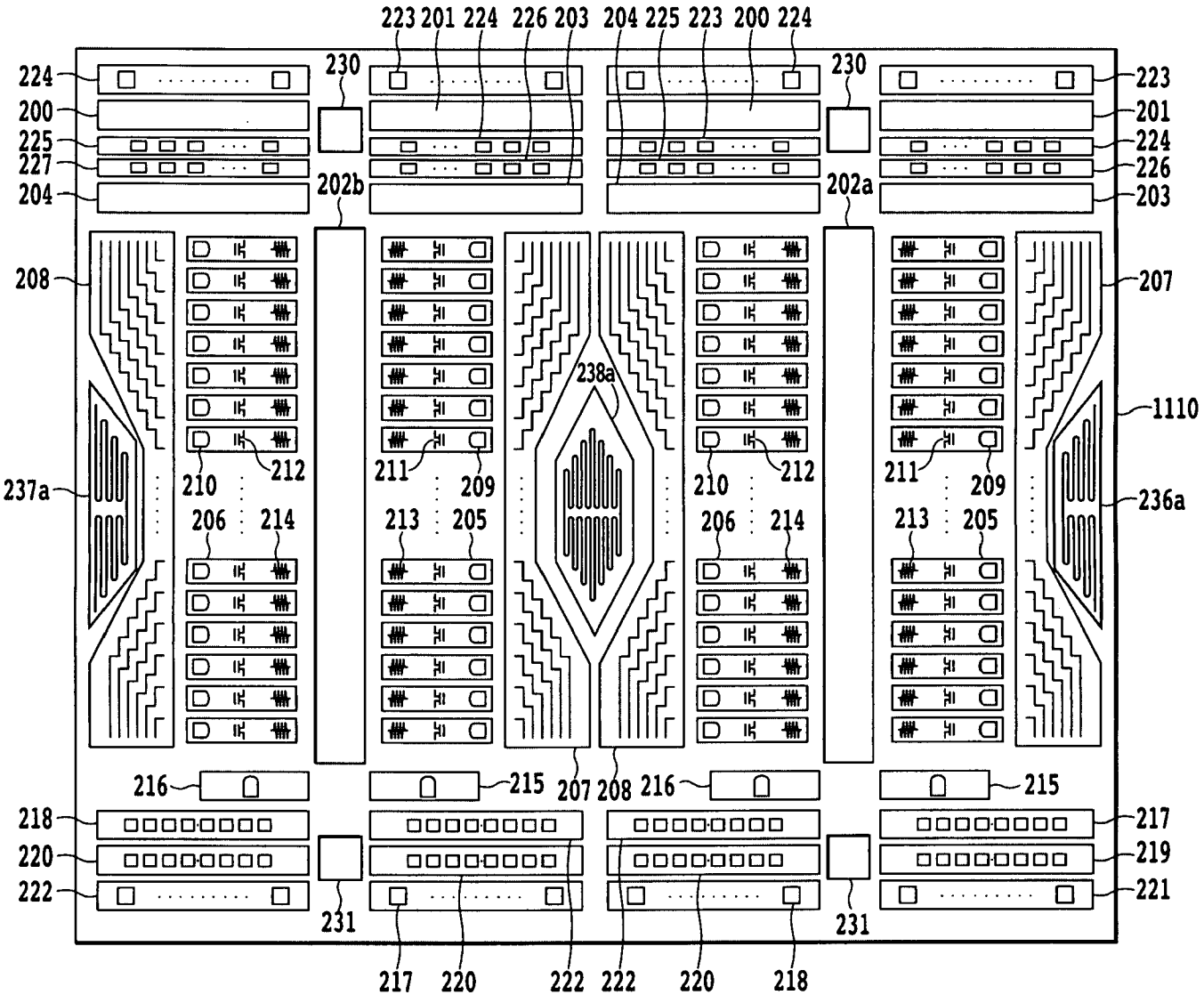
FIG. 11 is a schematic diagram according to another modified example of the second embodiment of the present invention and showing a wiring of signal lines for transmitting drive signals and a placement of temperature sensors.

In addition, although FIGS. 9 to 11 each illustrate a substrate including two ink supply openings, it is needless to say that the substrate may include three or more ink supply openings.

As shown in FIGS. 10 and 11, as in the cases shown in FIGS. 7 and 8 of the modified examples of the first embodiment, respectively, temperature sensors 236*a*, 237*a* and 238*a* may also be formed by use of a wiring layer.

The second embodiment or its modified example produces not only the same effect as described above, but also the following advantageous effects.

3. Advantageous Effects of Second Embodiment

In the foregoing second embodiment, the present invention is applied to the substrate provided with two ink supply openings. Here, when the two ink supply openings are provided for the inks with different tones (colors, densities), each of the openings is formed to pass through the substrate from the obverse surface to the reverse surface. Likewise, when the two ink supply openings are provided for the same ink, each of the openings is formed to pass through the substrate. In the former case, independent ink supply paths for the respective inks are typically formed in a supporting member that is a component of the print head for supporting the substrate. In the latter case, however, the print head may employ a configuration in which an ink supply path of a supporting member for the same ink is connected to an area entirely covering the two ink supply openings that are open to the reverse surface of the substrate, whereby the ink is distributed to each of the ink supply opening. In the latter case, the substrate may possibly be configured so that a reverse surface of the substrate is out of contact with the supporting member, partially at a portion on the opposite side from an area where the heater elements are arranged (hereinafter, this configuration is referred to as "an ink distribution configuration" for convenience).

In this ink distribution configuration, the following problems may occur if the print head falls into the state of the so-called "blank ejection" due to ink supply failure attributed to any possible factor. Since most of the thermal energy generated with driving of the heater elements is usually consumed as ink ejection energy, the temperature of the substrate itself gradually increases with an increase of operating time of the print head. In the case of the blank ejection, however, the thermal energy generated by the heater elements remains in the substrate, whereby the substrate is subjected to a sharp rise of the temperature. This is because the thermal energy transmitted from the heater elements to the substrate is not effectively transmitted to the supporting member in the configuration in which the reverse surface of the substrate is out of contact with the supporting member, partially at the portion on the opposite side from the area where the heater elements are arranged. This tendency is especially remarkable in a central portion of the heater element array where the length of a heat transmission route to the supporting member is long.

The foregoing second embodiment or its modified example is effectively applicable to even such an ink distribution configuration. The following description shows application examples thereof.

Figure 12:
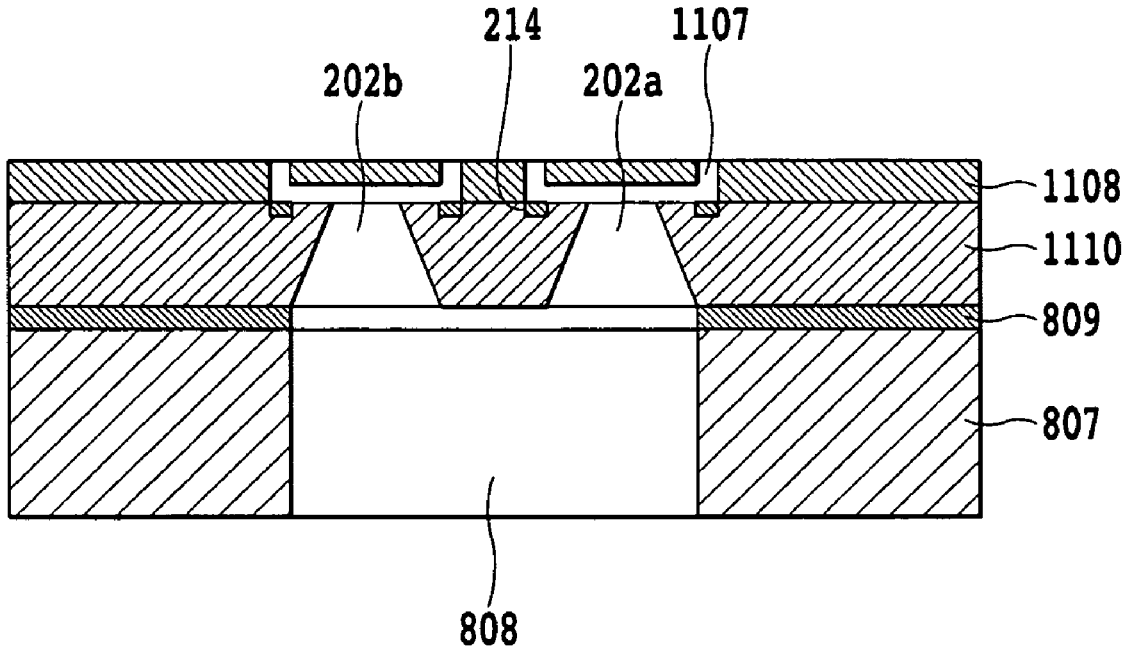
FIG. 12 is a schematic cross section view for explaining a configuration example of a substrate and its supporting member to which the second embodiment is effectively applied.

FIG. 12 is a schematic cross section view for explaining a configuration of a substrate and its supporting member that employ the ink distribution configuration. As shown in FIG. 12, a substrate 1110 includes two ink supply openings that are open on a reverse surface thereof, and is bonded to a supporting member 807 with an adhesive agent 809, at an area except for a communication portion with an ink supply path 808 to which the two ink supply openings are connected. Thus, a part of the substrate has the heater element array on its obverse surface and has the communication portion with the ink supply path 808 on its reverse surface. In other words, this part is not in contact with the supporting member 807 but faces a hollow portion.

Figure 13:
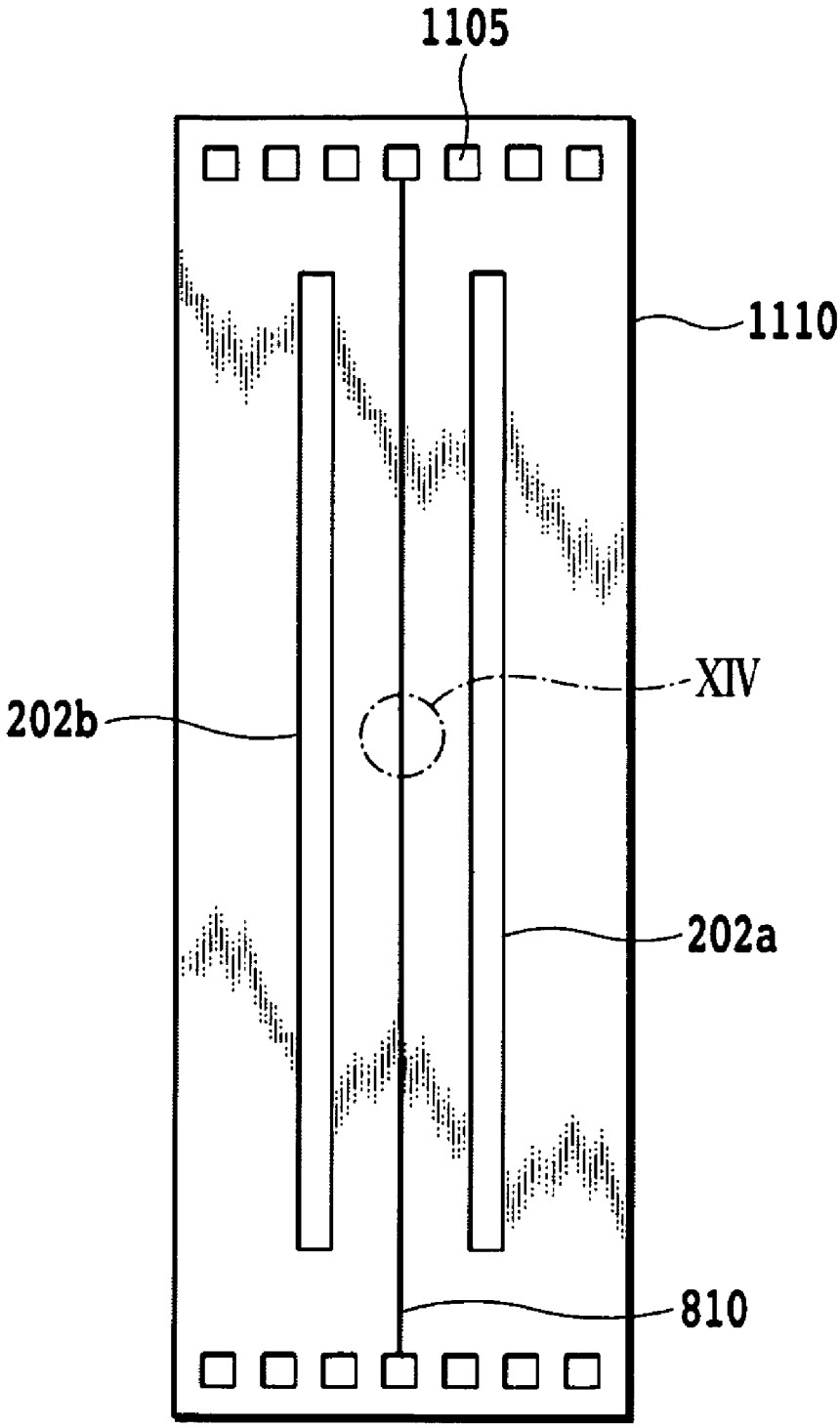
FIG. 13 is a schematic plan view showing an example in which the second embodiment is applied to a substrate having the configuration in FIG. 12.
Figure 14:
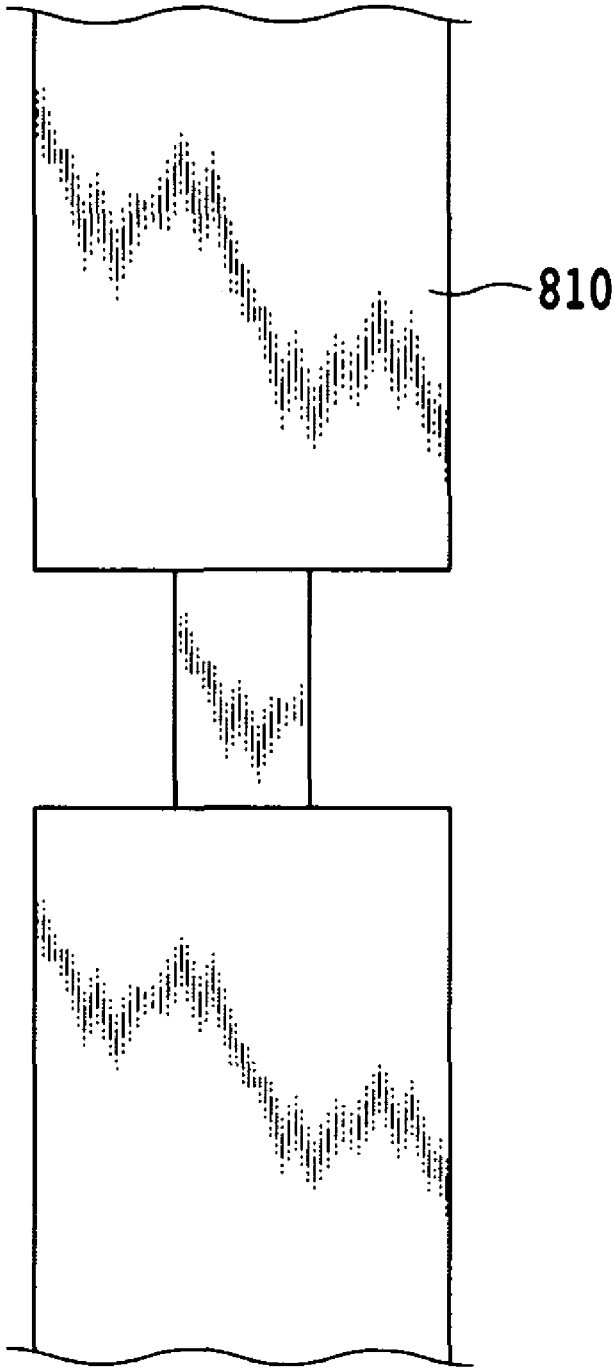
FIG. 14 is a schematic plan view showing a configuration example of a temperature sensor in FIG. 13.

FIG. 13 is a schematic plan view showing an example of a substrate in which the second embodiment is applied to such an ink distribution configuration. In the illustrated example, a wiring 810 is provided between the ink supply openings 202*a* and 202*b* to linearly extend from an electrode terminal 1105 disposed at one end of the substrate to an electrode terminal disposed at the other end thereof. When this wiring 810 itself is used to form a temperature sensor, the wiring 810 can be partially formed with a small width at a position XIV corresponding to the substantial center of the heater element array as shown in FIG. 14, and thereby can be configured to have higher resistance to achieve temperature detection with high accuracy. Instead, at the position P, the wiring 810 may be formed in the meandering shape, as shown in FIG. 10 or 11. Alternatively, as shown in FIG. 9, a diode temperature sensor can be inserted into the position P.

Figure 15:
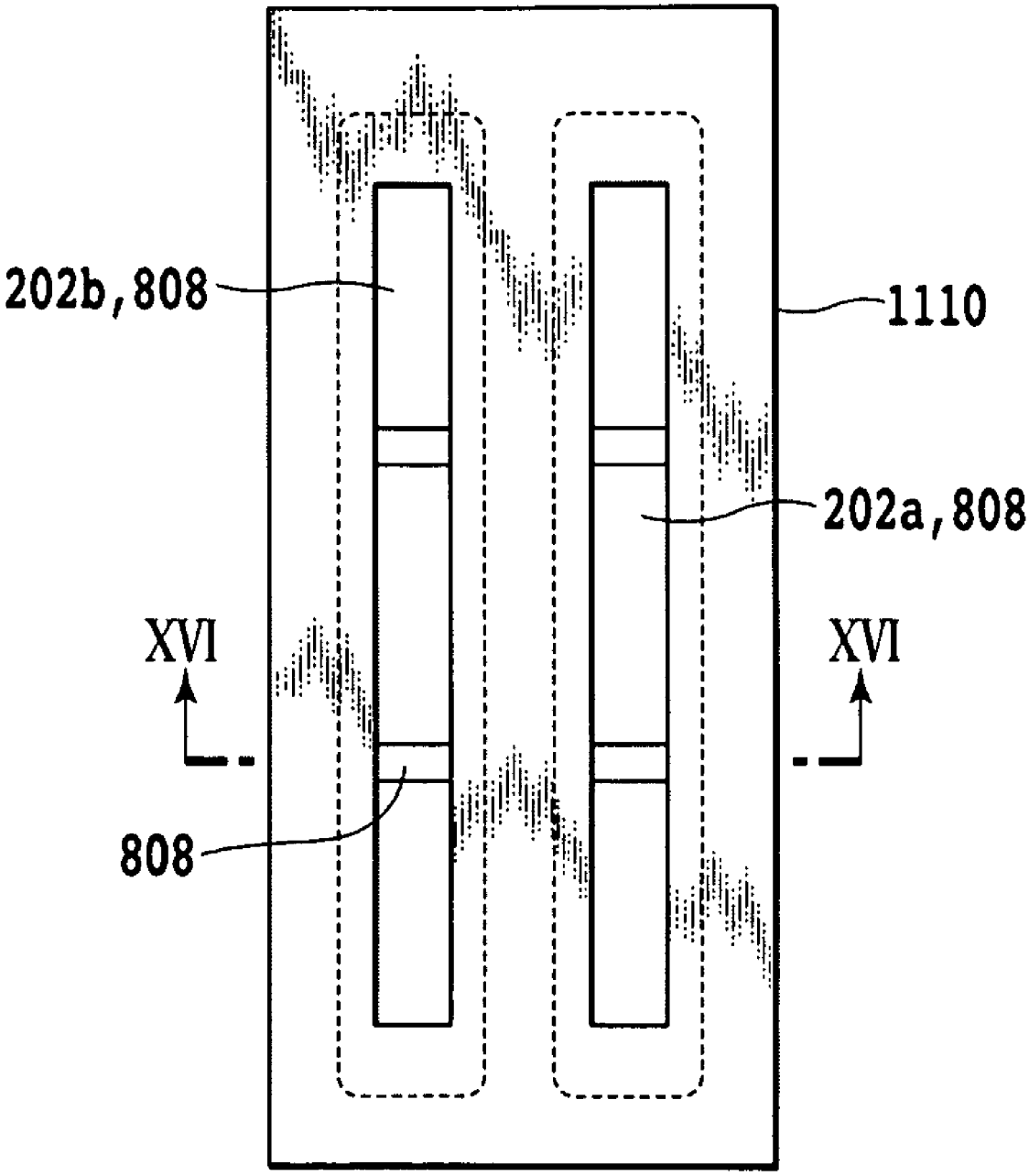
FIG. 15 is a schematic cross section view for explaining another configuration example of the substrate and its supporting member to which the second embodiment is effectively applied.
Figure 16:
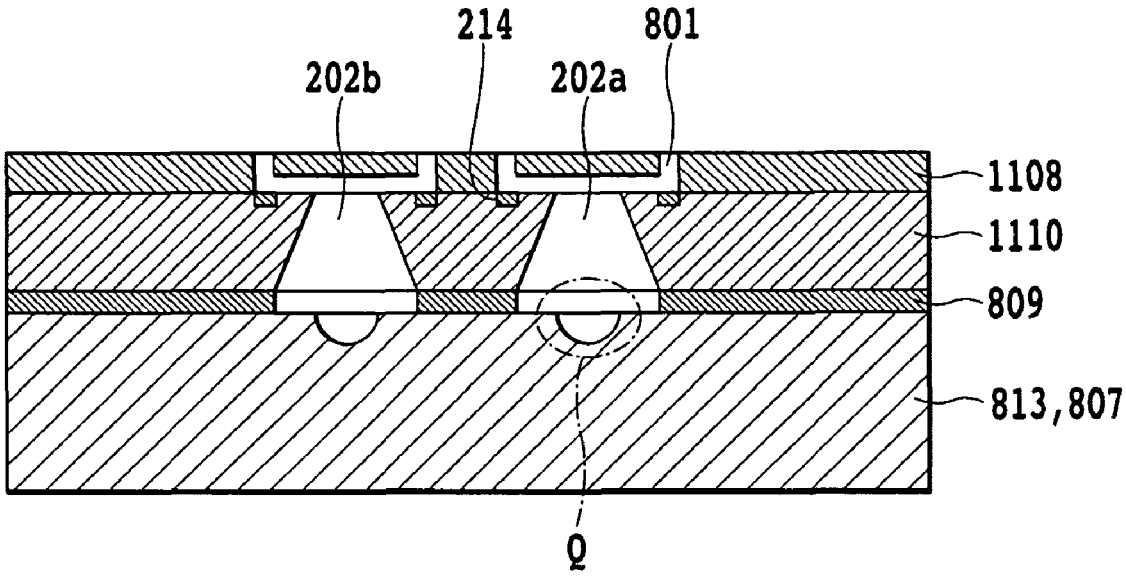
FIG. 16 is a schematic cross section view taken along the line XVI-XVI in FIG. 15.

FIG. 15 is a schematic plan view for explaining another configuration example of a substrate and its supporting member employing the ink distribution configuration, and FIG. 16 is a schematic cross section view taken along the line XVI-XVI in FIG. 15.

In this embodiment, the substrate 1110 is configured to have improved heat dissipation property by forming beams 813 partially in the ink supply path 808 in the supporting member 807, the path 808 communicating with the ink supply openings 202*a* and 202*b*. To put it differently, the substrate 1110 is configured to partially have an area in contact with the beams 813, although the supporting member does not exist in the area in the configuration in FIG. 12. Incidentally, a concave portion of each of the beams shown by Q in FIG. 16 is an engraved portion in a semicircular shape for surely allowing a sufficient amount of ink to flow at locations where the beams are formed. The concave portion may be in any other shape as long as the concave portion surely allows a sufficient amount of ink to flow.

Figure 17:
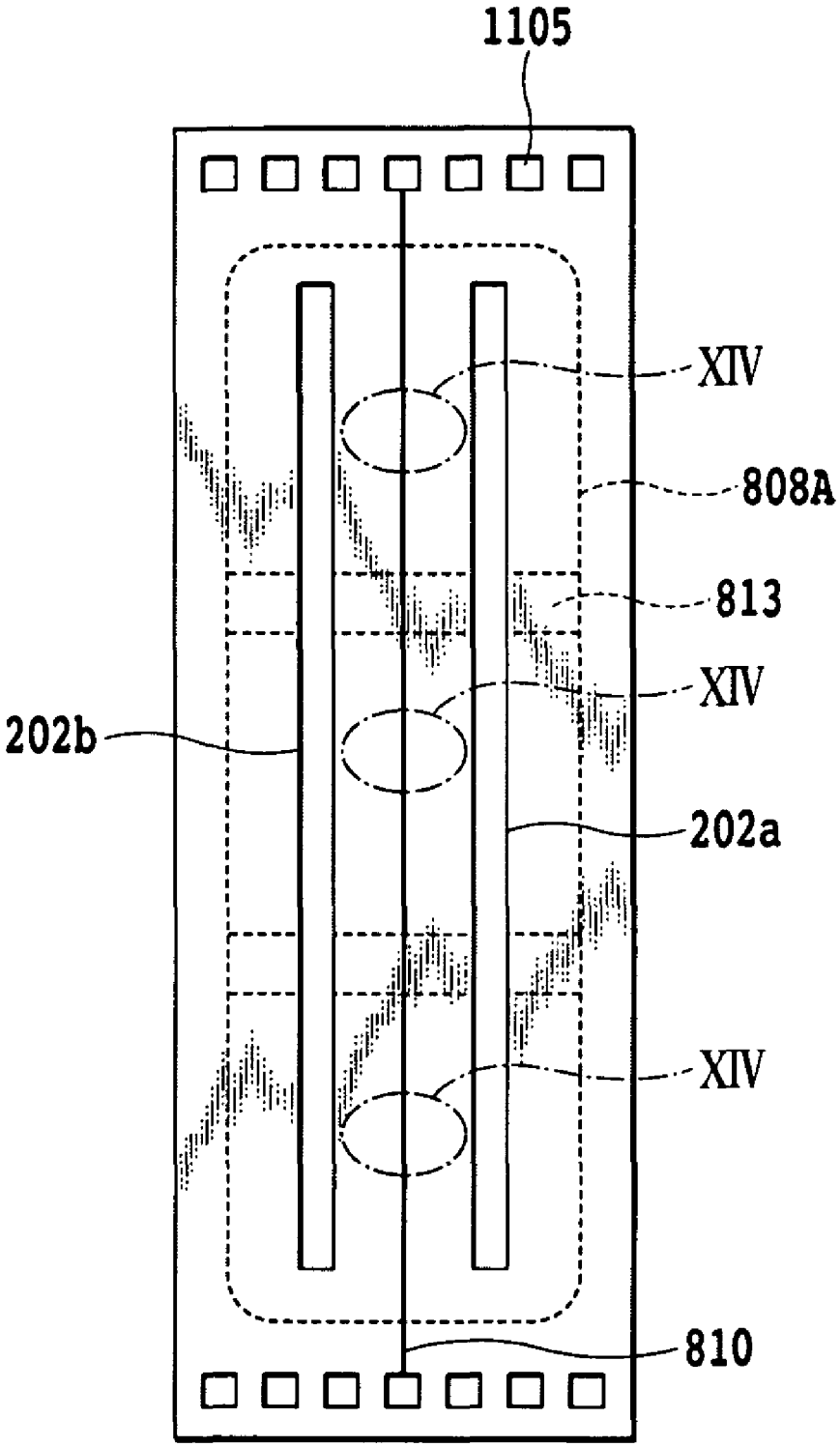
FIG. 17 is a schematic plan view of a substrate, and shows a placement of temperature sensors in the configuration in FIG. 15.

FIG. 17 is a schematic plan view of a substrate showing a way of arranging temperature sensors in the foregoing configuration. A broken-line portion 808A in FIG. 17 is a communication portion with the ink supply path 808 in the supporting member provided on the reverse surface of the substrate. The substrate 1110 is in contact with the supporting member 807 at the positions where two beams 813 are formed. The beams 813 are provided in the positions evenly dividing the communication portion into three areas. In the illustrated example, a temperature sensor is provided at a position R corresponding to the center of each of the divided areas where the substrate and the supporting member 807 are out of contact with each other. In other words, at this position, the wiring is formed to have a small width or is formed in the meandering shape, or a diode temperature sensor is installed in the wiring.

With the configuration in which the reverse surface of the substrate 1110 is in contact with the supporting member 807 through the beams 813 as shown in this embodiment, the heat of the substrate is likely to dissipate toward the supporting member. Thus, the reliability against abnormal temperature rise is improved. In addition, in this embodiment, attention is focused on the areas, i.e., the divided areas, which have low heat transfer property because the reverse surface of the substrate is out of contact with the supporting member. Thus, in these areas, the temperature sensors are formed to achieve further improvement of the reliability against temperature rise. By forming a substrate in the aforementioned configuration, the substrate is prevented from undergoing abnormal temperature rise. Moreover, even if abnormal temperature rise occurs by any chance, the substrate and therefore the print head are prevented from being damaged, on the basis of the detection of the temperature sensors.

Incidentally, the number and positions of beams may be determined as desired. Meanwhile, from the viewpoint of abnormal temperature rise detection, it is preferable to dispose a temperature sensor at the position R corresponding to the center of each of the divided areas. In order to achieve even more accurate detection of the temperature in the entire area of the heater element array, it is strongly desirable to dispose a temperature sensor at a position corresponding to the substantial center of the heater element array even through the position is a place where the heat is easily transferred through a beam. For instance, even when a beam is located in a position evenly dividing the area of the heater element array into two areas, it is preferable to dispose temperature sensors not only at positions corresponding to the centers of the respective divided areas, but also at a position corresponding to the substantial center of the entire heater element array, for example, on the obverse side at the position corresponding to the location of the beam.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-142677, filed May 30, 2008, which is hereby incorporated by reference herein in its entirety.

What is claimed is:

1. A substrate for an inkjet head comprising:

M×N energy generating elements for generating energy utilized to eject ink, arranged in an array, and divided into N blocks for performing time-divisional driving; and M signal lines for selecting energy generating elements to be driven in each of the N blocks, wherein the M signal lines include L signal lines (L<M) and (M−L) signal lines, the L signal lines for selecting, from the energy generating elements, L energy generating elements closest to a one end side of the substrate with respect to an arrangement direction of the energy generating elements, extending in the arrangement direction from a start point that is a portion in the one end side toward another end side of the substrate in the arrangement direction, the (M−L) signal lines for selecting, from the energy generating elements, (M−L) energy generating elements closest to the other end side from the energy generating elements, extending in the arrangement direction from a start point that is a portion at the other end side toward the one end side, wherein a number of the L signal lines crossing an intersecting direction intersecting the arrangement direction and a number of the (M−L) signal lines crossing the intersecting direction are decremented as distances from respective start points increase, and with the decrement in the numbers of the signal lines, the L signal lines and the (M−L) signal lines are arranged so that the remaining signal lines are shifted toward the energy generating elements, and wherein a temperature sensor for detecting a temperature of the substrate is provided in an empty area produced by the shift of the signal lines.

2. A substrate for an inkjet head as claimed in claim 1, wherein a relationship between the M bit signal lines and the L bit signal lines meets $L=M/2$ or $L\approx M/2$, and the temperature sensor is provided in a position corresponding to the center with respect to the arrangement direction in an area in which the energy generating elements are arranged.

3. A substrate for an inkjet head as claimed in claim 1, wherein the empty area is surrounded on three sides by the M signal lines.

4. A substrate for an inkjet head as claimed in claim 1, wherein the temperature sensor is configured of a diode.

5. A substrate for an inkjet head as claimed in claim 1, wherein the temperature sensor is a sensor using a wiring as a resistance element.

6. A substrate for an inkjet head as claimed in claim 5, wherein at a position corresponding to the center with respect to the arrangement direction in an area in which the energy generating elements are arranged, the wiring has a higher resistance value than at positions other than the position.

7. A substrate for an inkjet head as claimed in claim 6, wherein the wiring has a meandering shape at the position.

8. An inkjet head comprising:

a substrate as claimed in claim 1; and a member provided in contact with the substrate, and provided with ejection openings for ejecting ink by action of the energy generated by the energy generating elements.

9. An inkjet head as claimed in claim 8, wherein the substrate includes an ink supply opening passing from a obverse surface to a reverse surface of the substrate, and the energy generating elements are arranged along the ink supply opening that is open to the obverse surface of the substrate, the inkjet head further comprising:

a supporting member supporting the substrate and including an ink supply path for supplying an ink to the ink supply opening that is open to the reverse surface of the substrate, and wherein a plurality of the ink supply openings are communicated with each other via the ink supply path.

* * * * *